United States Patent [19]

Asker

[11] Patent Number: 4,669,409

[45] Date of Patent: Jun. 2, 1987

[54] WIND SHIP PROPULSION SYSTEM

[76] Inventor: Gunnar C. F. Asker, c/o Asker Enterprises, 60 E. 42nd St., New York, N.Y. 10165

[21] Appl. No.: 783,448

[22] Filed: Oct. 2, 1985

Related U.S. Application Data

[63] Continuation-in-part of Ser. No. 535,363, Sep. 23, 1983, Pat. No. 4,561,374.

[51] Int. Cl.[4] ..... B63H 9/04

[52] U.S. Cl. ..... 114/103; 244/207

[58] Field of Search ..... 114/102, 103, 104, 39; 244/207-210, 214

[56] References Cited

U.S. PATENT DOCUMENTS

| | | | |
|---|---|---|---|
| 2,078,854 | 4/1937 | Jones | 244/208 |
| 2,447,100 | 8/1948 | Stalker | 244/209 |
| 2,484,687 | 10/1949 | Carl, Jr. | 114/103 |
| 3,211,078 | 10/1965 | Asker | 98/36 |
| 3,598,075 | 8/1971 | Kenney | 114/102 |
| 4,047,883 | 9/1977 | Decker | 415/2 |
| 4,473,023 | 9/1984 | Walker | 114/103 |

FOREIGN PATENT DOCUMENTS

| | | | |
|---|---|---|---|
| 2545783 | 11/1984 | France | 114/103 |
| 57-95292 | 6/1982 | Japan | 114/103 |
| 56-78576 | 11/1982 | Japan | 114/103 |
| 353994 | 6/1961 | Switzerland | 114/102 |

OTHER PUBLICATIONS

Charrier et al, *Foundation Cousteau* . . . (4/26/85) 21--1-21-22, England.

*Dolphin Log* Sep. 1985 at 3.

Schult, *Curious Yachting Inventions (1974) at 61-79, New York.*

Cunnel et al, *Yacht Design* (1976).

JAMDA *Sailing Tanker "Shin Aitoku Maru" (9/83) at cover, 9.*

Howard-Williams, "Sails: Their Optimum Shape" (6/83) at 12, San Jose, CA.

Hazen, "Boundary Layer Control" (6/80) at 93, Cambridge, Mass.

*Primary Examiner*—Joseph F. Peters, Jr.

*Assistant Examiner*—Jesûs D. Sotelo

*Attorney, Agent, or Firm*—Christopher B. Garvey

[57] ABSTRACT

A sailing rig which comprises a rigid airfoil, with intakes on either side of its front. Air is drawn through the leeward intake into a front compartment, then by fan to a pressurized rear compartment, where it exits via a rearwardly directed jet nozzle on the airfoil's trailing edge. The airfoil may have an articulated jib and a pivotable jet nozzle.

14 Claims, 17 Drawing Figures

WIND SHIP PROPULSION SYSTEM

This is a continuation-in-part of U.S. patent application Ser. No. 535,363, filed Sept. 23, 1983 and U.S. Pat. No. 4,561,374. Priority is claimed from that date on any subject matter which may be common to these applications.

This invention relates to the utilization of wind as a propulsive force for water borne vessels and other surface vehicles, all of which will be hereinafter referred to as ships.

For many years man has used sails to harness wind as a propulsive force. Many different types of sail configurations and constructions have evolved in the quest for greater propulsion efficiency, maneuverability and ship control. While most sails have been of non-rigid character, formed of canvas or other cloth-like material, recent years have witnessed an increase of interest in rigid and semi-rigid sails of various types. While such interest has been apparently stirred by the promise of propulsive force obtainable from preprofiled airfoil configurations and the reduction in sail handling labor attendant use thereof; disadvantages such as difficulties in reefing or furling; lack of adaptability to changing wind conditions; extensive requirements for deck space that is not effectively available on commercial vessels; and expense and difficulties in construction to provide sufficient structural integrity have for the most part effectively precluded practical utilization thereof.

The term "rigid" will be employed as meaning a sail structure that is of essentially self-supporting character and in which the wind exposed surfaces are of such character, either alone or in association with underlying supporting structure, as to be substantially nondeformable under exposure to wind.

This invention may be briefly described as an improved construction for a rigid sail assemblage which includes, in its broad aspects, a rigid mainsail section contoured to provide a pair of rearwardly tapering airfoil surfaces which curve at their leading edges toward each other to form a convex curve as the mainsail's leading surface. At the trailing edge of the mainsail is a rearwardly directed jet nozzle.

Air is supplied to the jet nozzle from a rear compartment within the mainsail, pressurized with air taken in through the leeward of two intakes on either side of the leading surface of the mainsail.

The jet nozzle may be permanently aligned with the longitudinal axis of the mainsail but is preferably movable to align its jet with the lee surface of the mainsail.

Wind traveling across the mainsail follows the sail's airfoil curves imparting wind energy and force to the sail as the sail redirects the momentum and energy of the moving mass of air. With the jet nozzle operating, the wind is believed to remain attached to the jet by a Coanda effect which extends beyond the trailing edge of the sail. The air is effectively being redirected even beyond the trailing edge of the sail, involving a greater air mass, and increasig the effective sail area, lift, and propulsive force upon the sail. The jet enables the airfoil to remain effective at steeper angles of attack.

Since the jet is supplied by air which is taken in on the leeward side of the mainsail, the vacuum effect at the intake further reduces the pressure on the lee side. This increases the pressure differential between the leeward and windward sides, which results in a further increase in the propulsive force on the sail.

Each intake is preferably 20% and at least 10% larger in net intake area than the jet nozzle exhaust area.

The mainsail can be mounted in fixed orientation with a ship so that the longitudinal centerlines of both ship and sail are aligned. This arrangement has the virtue of low cost and simplicity of construction. However, it is aerodynamically preferable to mount the sail rotatably upon its ship so that it may be positioned optimally.

Another optional and preferred aerodynamic refinement is the mounting of a jib at the leading edge of the mainsail. The jib is pivotable around the leading edge and forms an effective airseal between the windward and leeward sides of the airfoil assembly which the two sails together comprise. The jib is intended to be rotated to windward to increase the effective angle of attack that the sails are capable of before stalling. If the intakes are so designed, the jib can also serve the function of sealing closed the windward intakes. The rigid mainsail section and a rigid jib section are both of complemental airfoil cross-sectional configuration. Together, they are rotatably displaceable, as a unit, through 360° relative to the ship centerline, about a pivot point just rearward of the mainsail's forward curvature (about $\frac{1}{3}$ of the way from the front of airfoil assembly 100), and with the jib section being further independently arcuately displaceable within a sector of predetermined angular extent relative to said mainsail section. Both the mainsail section and the jib section are preferably generally rectangular when viewed in elevation. The sail area of the jib should be no more than about 30% the area of the mainsail. They are disposed intermediate a pair of pressure differential isolating end plates disposed perpendicularly to the plane of the airfoil. The jib section has its trailing edges disposed in substantially coplanar abutting relation with the leading edges of the mainsail section. In a still further aspect of the subject invention, the jib section is pivotably displaceable along an axis at or near the leading edge of the mainsail and through a sector of about 25° to either side of the mainsail centerline. The opposite faces of the jib cooperate with the opposite faces of the mainsail section to provide either alone or in conjunction with auxiliary fairing panels and effectively independent of the jib setting, a substantially continuous smoothly curved composite airfoil sail surface on the lee side thereof and an acceptably continuous composite sail surface on the windward side thereof.

In the normal operation of the improved rigid sail assemblage, the leading edge of the jib section will be angled to windward of the mainsail section and the composite mainsail-jib sections adjusted to an angle to the wind which will achieve an essentially smooth laminar flow across the leading edge portion of the jib section and the trailing edge portion of the mainsail section on both the leeward and windward sides thereof, in association with a smooth laminar flow across the leeward surface of the entire compositely formed airfoil. Such desired laminar flow pattern is readily observable through the use of light strips of yarn, ribbon or tape, known conventionally as tell-tales or woollies, mounted at appropriate locations on the airfoil surface, which stream straight back in the desired laminar airflow condition.

Among the advantages of the subject invention is the permitted conjoint and individual mechanical adjustment of mainsail and jibsail section positions in accord with wind conditions with little or no expenditure of human effort; a permitted sailing closer to the wind;

permitted weathervaning of the sail assemblage to obviate sail furling; a permitted adjustment of the sail assemblage to obviate sail furling a permitted adjustment of the sail assemblage to secure desired laminar flow to be maintained across the sail on all points of sail, even off the wind. Still another advantage of the subject invention is the permitted mechanical reefing of the sail assemblage under high wind conditions by flattening the airfoil, i.e., by reducing the angle of jib section offset relative to the mainsail section and by reducing the angle of the mainsail-jibsail assemblage relative to the wind. Still further advantages of the subject invention are a reduction in required deck space in comparison to earlier suggestions as to rigid sail configuration with said reduction's attendant advantage for commercial ships with need for large deck space for cargo hatches and cargo handling equipment and the facilitation of computer controlled sailing operations wherein sail section position is automatically varied in response to sensed conditions of wind velocity, wind direction, course heading and ship speed.

Another advantage is that the configuration of the present invention lends itself to strong construction without elaborate aerodynamically inefficient external members. The structurally functional end plates actually add to the aerodynamic efficiency of the airfoil.

Additionally, the relative balance of wind pressure fore and aft of the rig's rotational axis eases the force needed to trim it, when compared to that needed to trim a conventional soft fore-and-aft sail on a boom pivoted at its forward end.

Another significant advantage of the subject invention is the fact that the jib is mounted on the leading edge of the mainsail. This enables the present invention to sail more effectively at angles closer to the wind.

When the jet is operating it provides the additional advantages of:

- a greatly increased effective sail area;
- an aft-directed jet which by itself provides some propulsive force;
- a leeward air intake which induces a vaccuum effect that reduces air pressure on the lee side of the sails, further adding to their propulsive force;
- greatly increased thrust, perhaps 3–5 times the thrust of soft sails having an equal area; and
- an ability to effectively utilize wind power in lighter breezes than would otherwise be feasible.

Another advantage of the jet version is that its effective sail area can be reduced, effectively reefing the rig, by the simple expedient of shutting off the fan means which power the jet.

The object of this invention is the provision of an improved rigid sail assemblage for wind powered or wind assisted ship propulsion, the effective sail area and efficiency of which may be increased by the actuation of a powered jet.

Other objects and advantages of the subject invention will become apparent from the following portions of this specification and from the appended drawings which disclose, in accord witth mandate of the patent statute, a presently preferred embodiment of a rigid sail assemblage that incorporates the principles of this invention.

Referring to the drawings.

Figure 1:
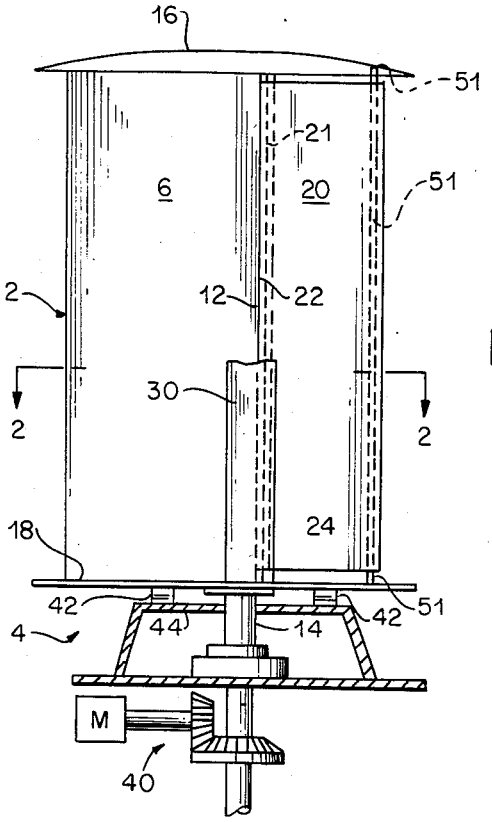
FIG. 1 is a schematic side elevation of a rigid sail assemblage incorporating the principles of this invention.
Figure 2:
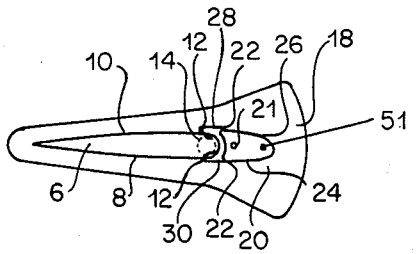
FIG. 2 is a sectional view taken on the line 2—2 of FIG. 1.

Referring to the drawings, and particularly to FIG. 1, there is provided a rigid sail assemblage that includes a multielement airfoil sail assembly generally designated 2 and a rotatable mounting means therefore, generally designated 4.

The multielement sail assembly 2 includes a rigid mainsail section 6, of generally rectangular elevational configuration. The defining side wall surfaces thereof are arcuately contoured suitably curved to provide a pair of rearwardly tapering symmetric airfoil surfaces 8 and 10, as most clearly shown in FIGS. 2 through 5 of the drawings. The spaced apart leading edges or luffs 12 of the mainsail section 6 are disposed on either side of a vertical axis of rotation of the self-supporting structure for the mainsail section which rotates upon a shaft 14 around said axis. The upper and lower marginal edges of the mainsail section 6 are surmounted by a pair of perpendicularly disposed and "Y" or "V" shaped end plates 16, 18. These end plates serve as pressure differential isolating means between the leeward and windward sail surfaces when the sail assemblage is subjected to wind forces, as well as serving as part of the rigid sail assemblage supporting structure. The end plates 16, 18, mainsail section 6, and shaft 14 form a structure that is rotatable through 360° as a unit, as will hereinafter be described in more detail.

The multielement sail assembly 2 further includes a rigid jib section 20 also of generally rectangular elevational configuration and mounted with its spaced trailing edges 22 disposed in essentially coplanar relation with the leading edges 12 of the rigid mainsail section 6. The jib section 20 also includes a pair of defining side wall surfaces of arcuate configuration to provide a pair of forwardly tapering symmetric airfoil surfaces 24 and 26. Leading and trailing edges are herein defined with reference to wind direction, with the leading edge, conventionally known as the luff, and sometimes herein called the front, being that first struck by the air flowing past the sail. The trailing edge or leech will sometimes be referred to as the rear. These terms will be used herein independently of the ship's fore and aft orientation, since the rig is rotatable upon the ship. The airfoil surfaces 24 and 26 of the jibsail section are complementally contoured relative to the airfoil surfaces 8 and 10 respectively of the mainsail section 6 so as to provide a smooth, continuous composite airfoil surface on the leeward side of the sail assemblage essentially independent of the angular disposition of the jib 20 relative to the mainsail section 6 as will be hereinafter described. Preferably the trailing edges 22 of the jibsail section 20 are provided with extending elastically deformable fairing panels or strips 28 and 30, the trailing portions of which are normally biased with sliding overlapping interfacial relation with the leading edge portions of the airfoil surfaces 8 and 10 of the mainsail section 6.

As heretofore described, the mainsail section 6 is fixedly secured both to the shaft 14 and to the upper and lower selectively shaped end plates 16, 18. The shaft 14, mainsail section 6, end plates 16 and 18 and the jib 20 are adapted to be rotated, as a unit, through 360° relative to the centerline of the ship. Such rotative displacement can be effected by rotation of the shaft 14 and end plates 16 and 18 as a unit as by a bevel gear interconnection, generally designated 40, at the base of the shaft 14.

Such rotative displacement can be facilitated by a plurality of roller elements, such as casters 42 mounted on the underside of the lower end plate 18 and riding on a stationary thrust plate 44.

Although desirably of equal vertical extent with the mainsail section 6, the jib 20 is of a smaller sail area preferably being of a sail area about one-third of that of the mainsail section 6. The jib 20 is also supported in part by the shaft 14 or alternatively on a pivot rod 21 slightly forward of the mainsail and is pivotally mounted thereon for permitted independent rotative displacement relative to the mainsail section 6 and selective setting relative thereto within a sector of about 25° on either side of the mainsail section longitudinal centerline.

At any selected angular position of the jib 20 relative to the mainsail section 6, one pair of the complementally contoured airfoil surfaces of the mainsail and jib sections will form a smooth, continuous, curved airfoil surface on the lee side of the assemblage and a pair of angularly offset airfoil surfaces which compositely form a relatively flat surface on the windward side. Any localized discontinuities of the junctions of the edges, particularly on the windward side, will be minimized by the fairing strips or panels 28, 30.

Each fairing strip or panel is suitably in the nature of a thin sheet of resiliently deformable material adapted to be mounted on the trailing edges 22 of the jib airfoil surfaces, sized to extend vertically from endplate to endplate, and faired so that the panel's outer surfaces are coplanar with the outer airfoil surfaces of the jib section. The rearwardly extending portions of the fairing panels are preferably of tapering cross-section, being thinner at their trailing edges. The center portions thereof are suitably curved in continuance of the jib airfoil surfaces to prebias the trailing edge portions into overlapping interfacial relation with the outer airfoil surfaces 8 and 10 of the mainsail section 6.

Figure 10:
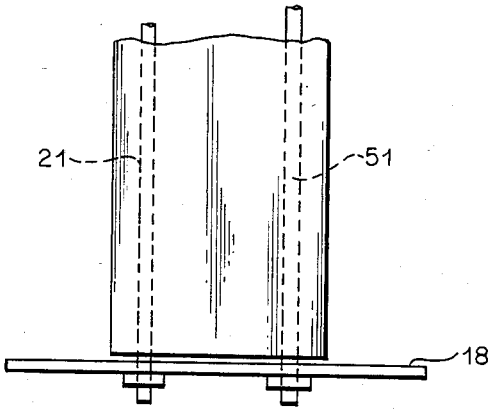
FIG. 10 is a side elevation of a portion of the airfoil showing the mounting of the jib sail on the end plate.
Figure 11:
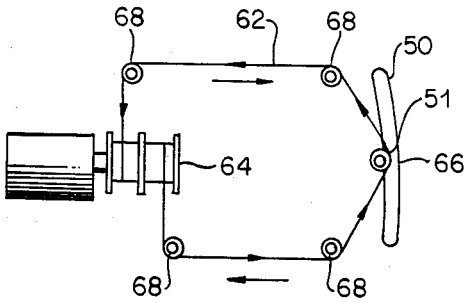
FIG. 11 is a schematic diagram in the nature of a top view showing motorized means of adjusting the jib sail.
Figure 12:
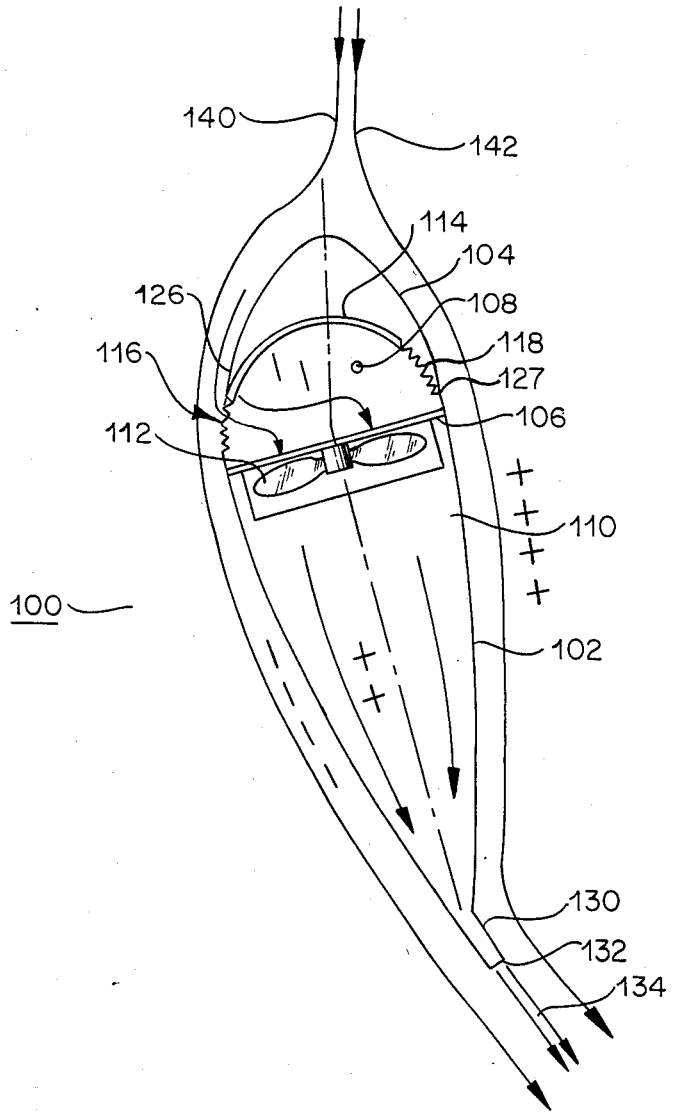
FIG. 12 is a plan view in section of the aspirated version of the airfoil assembly.
Figure 13:
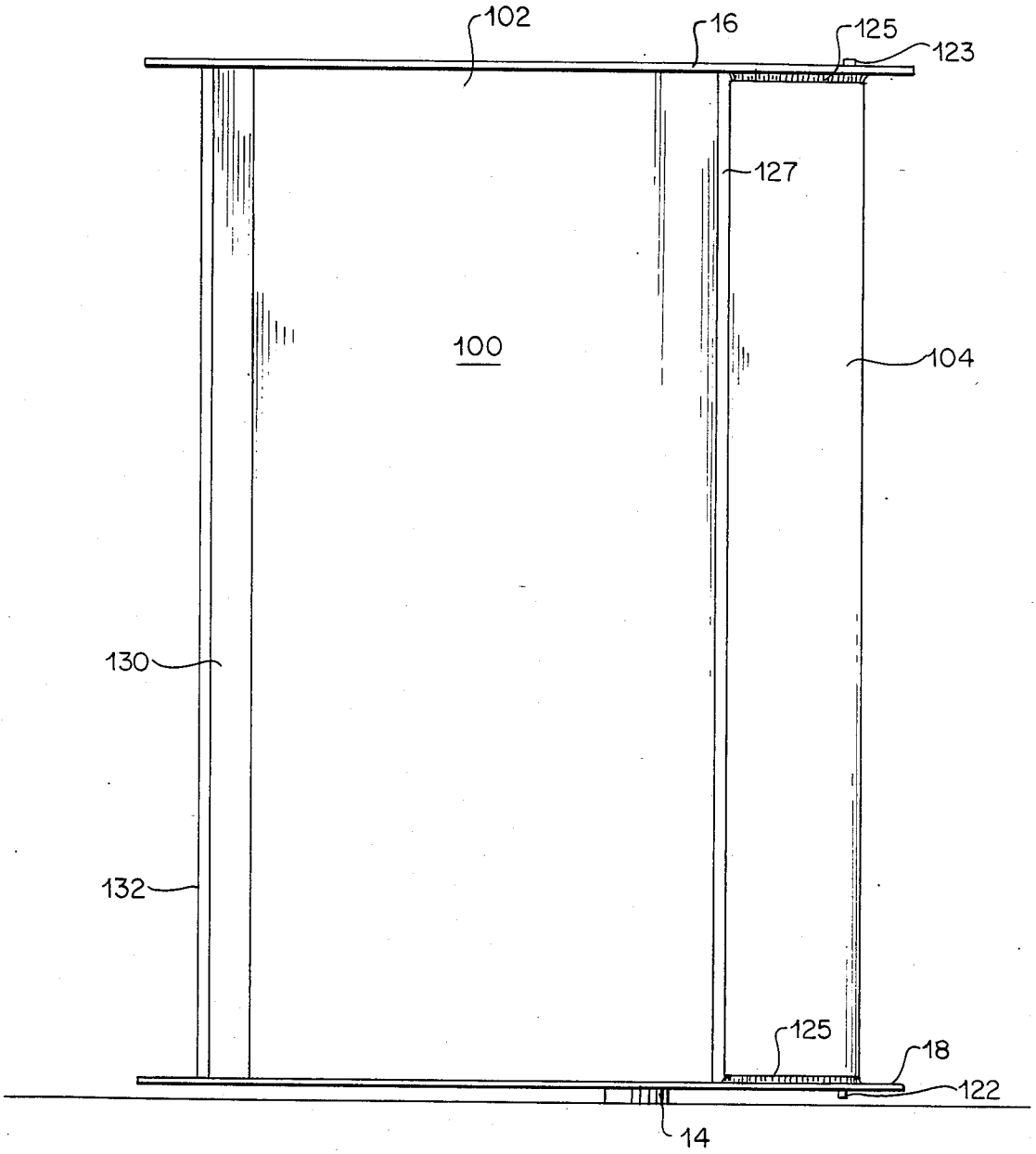
FIG. 13 is a windward side elevation thereof.
Figure 14:
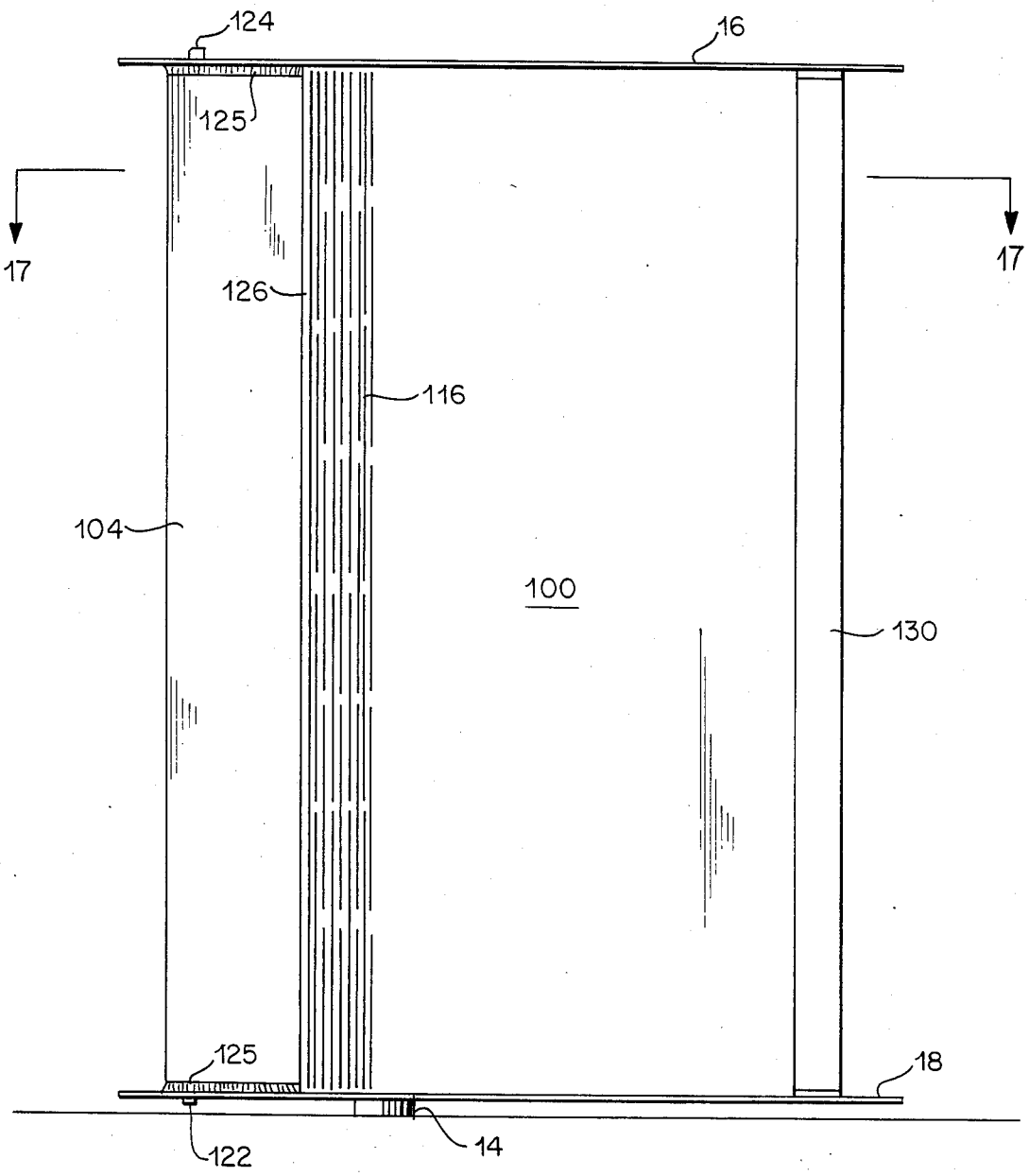
FIG. 14 is a leeward side elevation thereof.
Figure 15:
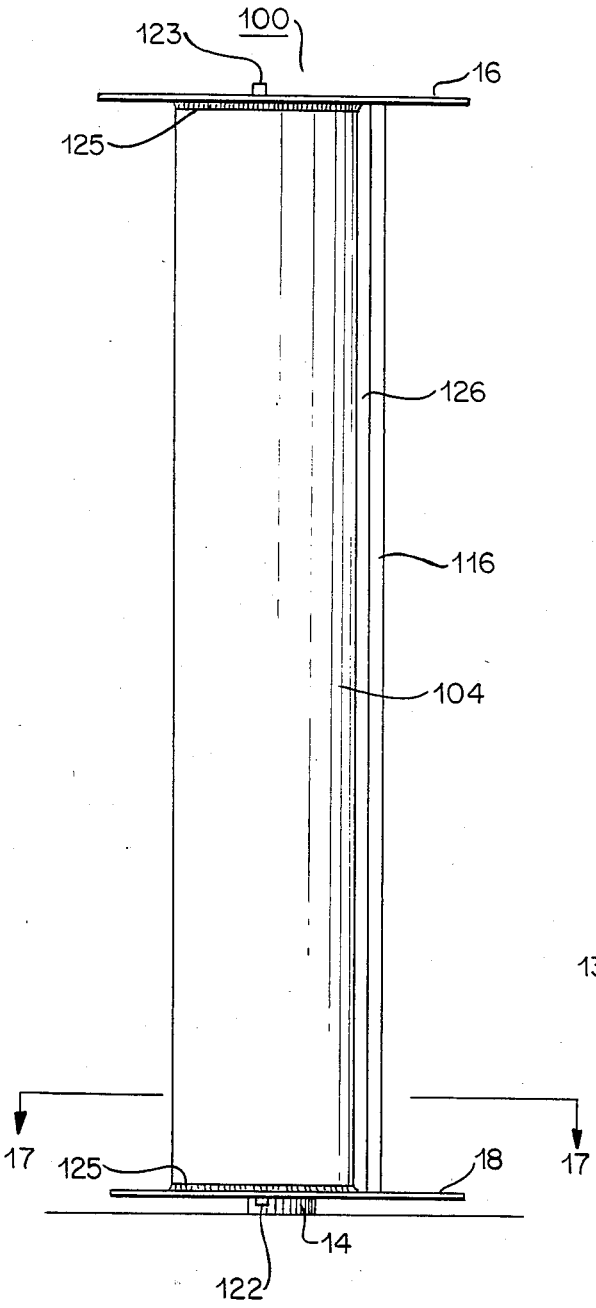
FIG. 15 is a front elevation thereof.
Figure 16:
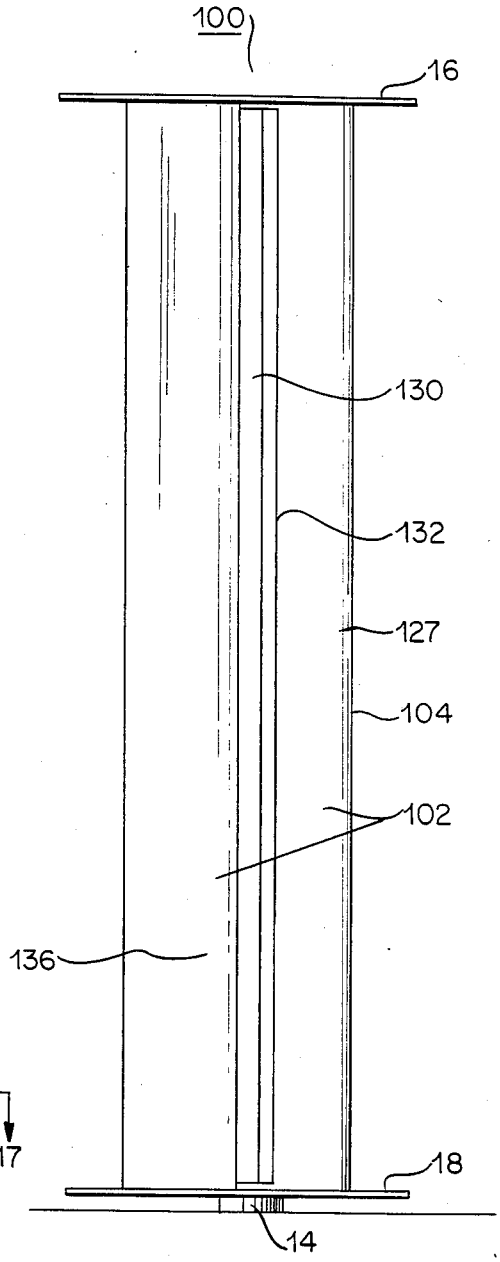
FIG. 16 is a rear elevation thereof.

As previously pointed out, the jibsail section 20 is mounted so as to be independently rotatably displaceable through a predetermined sector, as for example 25° on either side of the mainsail section centerline. Although not shown in detail, such independent rotative displacement as shown in FIGS. 10 and 11 may be controlled by a pair of arcuate guide rails or slots 50 in the end plates 16, 18 operatively engageable by the extended ends of rod 51 which protrude beyond the upper and lower marginal edge portions of the jibsail section 20. Selective rotative displacement of the jibsail section 20 can be effected manually by means of externally mounted sheets or such can be effected by mechanical means, for example, by a belt arrangement as shown in FIG. 11, comprising a possibly elastic belt 62, each end of which is wound in opposite rotation to the other around one section of a double spool 64 so that as one end of said belt is wound up, the other end is unwound and visa versa, the center of the belt 66 being connected to the protrusion of rod 51, said belt 62 running between spool 64 and rod 51 via a plurality of guide pulleys 68.

When the ship is at rest, as at anchor, on a mooring, or docked, the angle of the jibsail section 20 is conveniently zeroed at the centerline of the mainsail section 6, and the airfoil assembly rotational adjustment means is disengaged to allow the entire airfoil assembly 2 to the rotate as an entity freely with and about the shaft axis. Since shaft 14 is jibward of the center of wind pressure on the airfoil assembly 2, the entire assembly will weathervane and present its smallest surface, i.e., the jib luff 60, to the wind, thus effectively furling the rig by minimizing resultant wind force thereon.

Frictional or viscous damping means should be applied to shaft 14 to prevent rotational fluttering of the furled rig in gusty winds. The windage of the furled rig may help damp out rocking of the ship while at anchor.

Endplates 16 and 18 serve, in addition to adding constructional rigidity to the sail assemblage, the aerodynamic function of blacking the flow of high pressure air from windward to leeward around the top and bottom of the airfoil assembly 2. Such blocking action results in the development of higher pressure differentials between the windward and leeward sides and thereby creates higher resultant lift and driving force on the top and bottom end portions of the airfoil 2.

Figure 3:
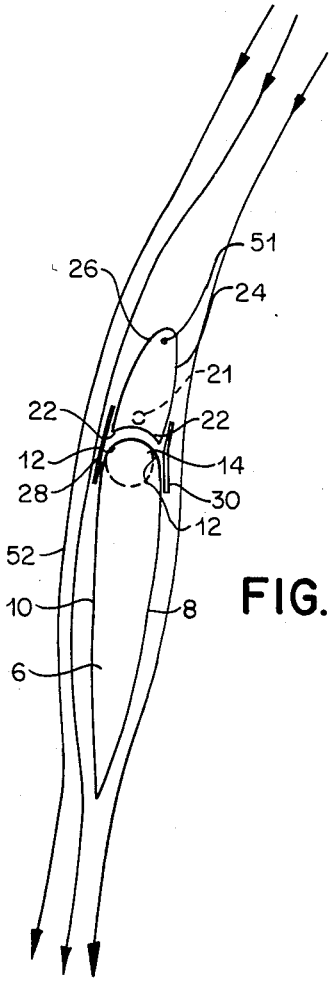
FIG. 3 is a schematic diagram in the nature of a section, showing the interaction of the wind with the sail assemblage on a closehauled starboard tack.
Figure 4:
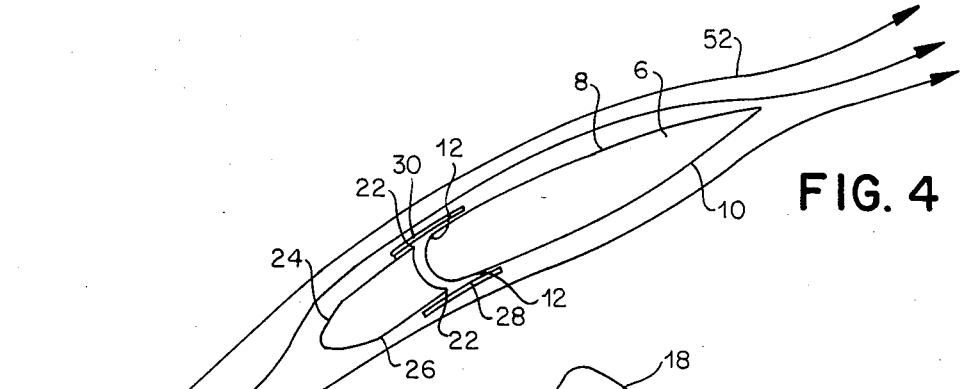
FIG. 4 is a schematic diagram in the nature of a section, showing the interaction of the wind with the sail assemblage when the wind is following from the ship's port quarter.
Figure 5:
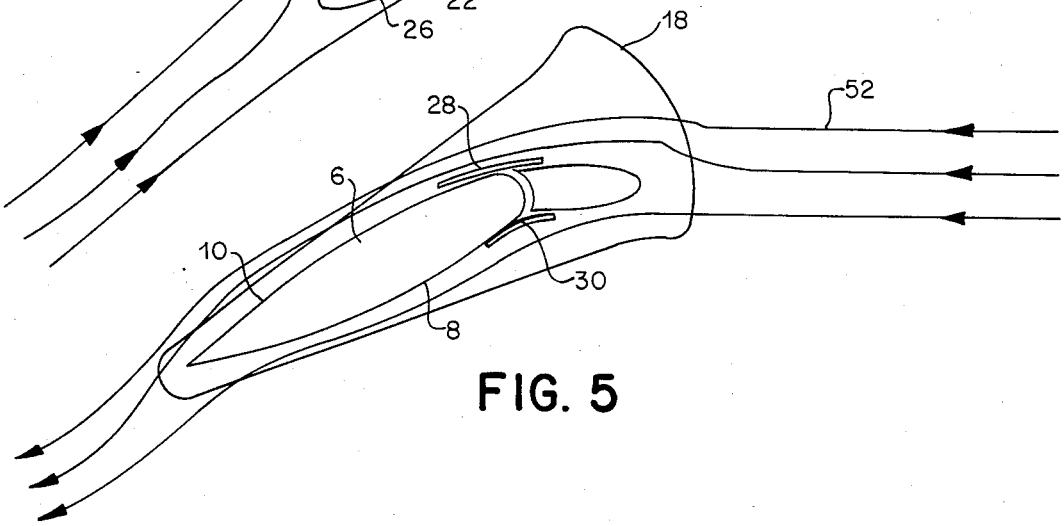
FIG. 5 is a schematic diagram in the nature of a section, showing the interaction of the wind with the sail assemblage when the ship is on a starboard tack beam reach.

As shown in FIGS. 3, 4 and 5, different apparent wind speeds will dictate different angular relationships between jib 20 and mainsail 6 to achieve maximum forward thrust from said wind. Generally, slower wind speeds will be able to follow a deeper curve as depicted in FIG. 5, while high wind speeds will dictate a flatter curve as depicted in FIG. 3.

Figure 6:
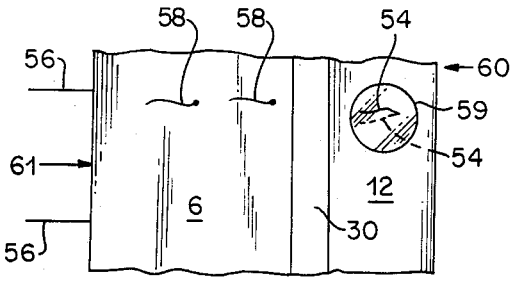
FIG. 6 is a side elevation of a portion of the airfoil showing the preferred location for and behavior of the tell-tales under laminar flow conditions.
Figure 7:
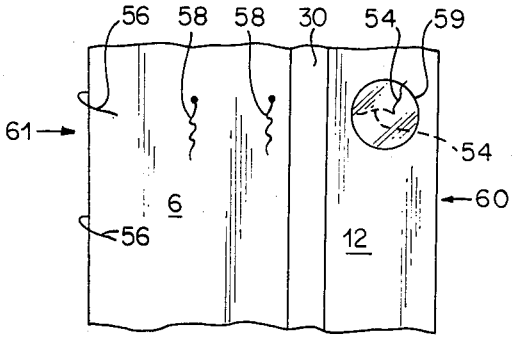
FIG. 7 is a side elevation, as shown in FIG. 10, depicting the behavior of the tell-tales on the leeward side of a stalling airfoil.

Laminar flow, shown by the flow lines 52 in FIGS. 3, 4 and 5 can be readily ascertainable when underway through the employment of small strips of material, 54, 56, 58, preferably red wool yarn, conventionally known as tell-tales, at appropriate locations across the airfoil, more specifically as shown near the jib luff 60, at the leech 61 of the mainsail 6, and at various locations across the mainsail section. When all the tell-tales are streaming straight back as shown in FIG. 6, laminar flow has been achieved. When the luff tell-tales 54 lift or dance erratically, as shown in FIG. 7, an appropriate correction such as reducing the angle of the longitudinal axis of the mainsail relative to the wind direction should be effected until the leech tell-tales 56 again stream straight back as shown in FIG. 6.

Figure 8:
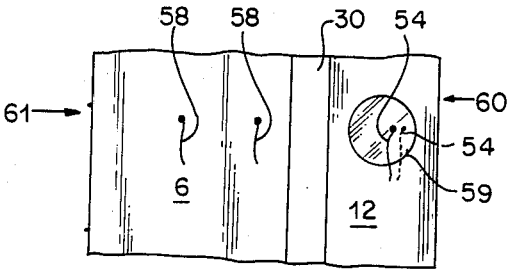
FIG. 8 is a side elevation, as shown in FIGS. 10 and 11, depicting the behavior of the tell-tales on the windward side of a severely stalled airfoil.
Figure 9:
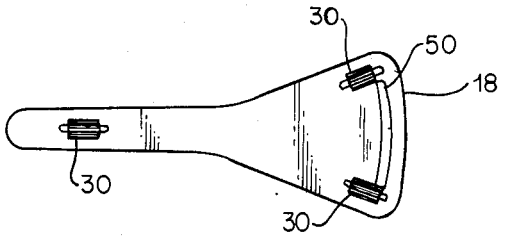
FIG. 9 is a view of the underside of the lower plate showing preferred positions for the trust rollers 30.

As illustratively shown in FIG. 8, when tell-tales 54, and 58 on both the windward and leeward surfaces of the airfoil 2 limply hang straight down, the airfoil 2 is severely stalled and its angle relative to wind direction should be reduced significantly. Observation of tell-tales can be facilitated by installing areas of transparent material 59 as viewing ports through the surface of the airfoil whereon the tell-tales 54 are mounted.

One significant advantage of the present invention is that, unlike conventional Marconi rig sails, the entire multi-element airfoil assembly can be rotated 360° relative to the ship. This permits the obtaining of optimized lift from the sail assemblage on all points of sail, as shown in FIGS. 3 through 5, even when running or broad reaching.

The preferred jet assisted version of the invention is shown in FIGS. 12–16. An airfoil assembly, generally designated 100, is comprised of a self-supporting mainsail 102 rotatably mounted upon shaft 14, and of jib 104. As in FIG. 12, mainsail 102 is divided by bulkhead 106 into a front compartment 108 and a rear compartment 110. Fan means, which may be one or more bladed, vaned, or centrifugal fans 112, are mounted on the rear side of bulkhead 106, over one or more suitably sized aperatures in the bulkhead. In operation, fan 112 draws air from the front compartment 108 through an opening in bulkhead 106 and into rear compartment 110. This creates a negative atmospheric pressure or partial vacuum in front compartment 108 and a positive pressure in the rear compartment. Front wall 114 of the front compartment 108 comprises a semicylindrical surface, the exterior of which forms a convex curve as the mainsail's leading surface. On either side of this front wall 114 are air intakes 116, 118. These intakes are usually comprised of a series of slots or holes and are shown better in FIGS. 14–15. Each intake can be closed with valve means which are capable of opening the leeward intake while closing the windward. In the preferred embodiment the valve means comprises jib 104, mounted at the leading surface of the mainsail and pivoted thereat; i.e., pivoted on an axis on or near the leading surface.Preferably the axis is at the radial center of the front wall 114's semicylindrical curve. The jib may be mounted to said axis by hinge means, generally designated 121, in FIG. 17.

Figure 17:
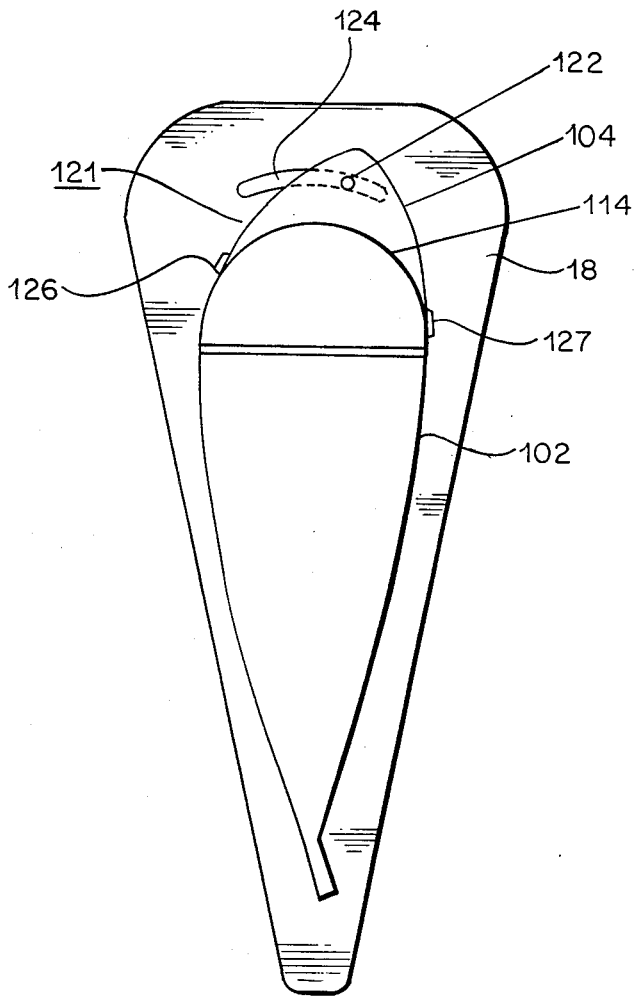
FIG. 17 is a plan view taken in section of the airfoil assembly, showing the pivotable mounting of the jib.

FIG. 17 shows the hinge means or jib pivot mechanism in detail. The trailing edges and associated fairing strips 126, 127 of jib 104 are pressed firmly against front wall 114 of mainsail 102 by bottom pin 122 and top pin 123 (FIG. 15) which are each guided by an arcuate slot 124 in the lower endplate 18 and in upper endplate 16 (upper slot not shown). Jib 104 may be pivoted by pins 122, 123 in the slots up to about 25° to windward, which increases the effective stall angle of airfoil assembly 100.

Airseal means, such as bristles 125, prevent air from leaking from windward to leeward between jib 104 and endplates 16, 18.

When jib 104 is pivoted to windward as shown, it uncovers and opens the leeward intake 116, and covers and closes the windward intake 118. Fairing strips 126, 127 may be located on the trailing edges of jib 104 to provide a more effective airseal to close windward intake 118 and to help smooth the transitional external airflow from jib 104 across mainsail 102.

Air is drawn in from the leeward side of airfoil 100 through leeward intake 116 by the partial vacuum in front compartment 108, creating a low pressure zone on the leeward surface of airfoil 100. The difference between this leeward low pressure and normal atmospheric pressure on the windward surface contributes to propulsive force on the airfoil 100. After being sucked through intake 116 into chamber 108, the air is drawn by fan 112 through an aperature associated with fan 112 in bulkhead 106 and pressurizes compartment 110.

Jet nozzle 130 has a width perhaps about 2–3% the length of airfoil 100 and a height preferably that of mainsail, 102 which width and height comprise its nozzle exhaust area 132. Note that the net open area of each intake 116, 118 should be preferably 20% and no less than 10% greater than the nozzle exhaust area. Nozzle 130 occupies the entire trailing edge of mainsail 102 and is rearwardly directed, but is preferably pivotable so that its jet 134 can be aligned with lee surface 136 of mainsail 102. Nozzle 130 provides an exit for pressurized air in rear compartment 110. This air is directed through nozzle 130 in an air jet 134 aligned with the lee surface 136 of mainsail 102.

Wind approaching the airfoil assembly 100 divides at the leading edge of jib 104 into a leeward airstream 140 and a windward airstream 142. Windward airstream 142 is directed to windward by the windward surfaces of jib 104, then of mainsail 102, then of movable jet nozzle 130, and then by jet 134, to which the stream 142 is believed to attach by the Coanda effect.

Leeward airstream 140 becomes restricted, as in a venturi nozzle, in its path between the curved flow across the airfoil and the general air mass flow of the apparent wind. The restriction is believed to increase stream 140's velocity and thereby reduce leeward air pressure, contributing to pressure differential and propulsive force. Specifically, the stream 140 passes the lee of jib 104, and then across the lee of mainsail 102, at the leading edge of which much of stream 140's air is sucked into intake 116, further contributing to lee side pressure drop, pressure differential, and propulsive force.

As the remaining air of stream 140 flows across the lee 136 of mainsail 102 and nozzle 130, its direction is changed, resulting in changes to the energy and momentum of the air mass, which changes react against the airfoil to provide propulsive force. Leeward air stream 140 also is believed to remain attached by the Coanda effect to jet 134, well past the trailing edge of airfoil 100.

It can be seen that by this attachment to the jet, the airstreams 140, 142 are affected well past the trailing edge of mainsail 102 which gives the effect of greatly increased effective sail area.

Combining normal airfoil forces, the reduced pressure on the lee from intake 116, the reactive force of jet 134, and the increased effective sail area of jet 134 provides a thrust which may be 3 to 5 times the thrust of a soft sail having equal area.

I claim:

1. A sailing rig comprising:

a rigid mainsail contoured to provide a pair of rearwardly tapering airfoil surfaces which curve at their leading edges toward each other to form a convex curve as the mainsail's leading surface;

a rearwardly directed jet nozzle on the trailing edge of the mainsail;

intakes on the left and right sides of the leading surface of the mainsail;

a mainsail interior which is divided into a front and rear compartment, and in which fan means pressurize the rear compartment with air drawn from the front compartment;

valve means for closing the windward intake;

a net inlet area of each intake which is at least 10% larger than the total area of jet nozzle exhaust;

the jet nozzle being moveable to align its jet with the lee surface of the mainsail;

the mainsail being mounted to be rotatable 360° in a horizontal plane;

a rigid jib contoured to provide a pair of forwardly tapering external airfoil surfaces having their trailing edges disposed in substantially coplanar relation with leading edges of said mainsail, fitting so closely thereto as to form an effective air seal between said mainsail and said jib; and means for pivoting said jib at the leading surface of the mainsail.

2. A sealing rig according to claim 1 in which the trailing portion of the jib serves as said valve means for closing the windward intake.

3. A sailing rig according to claim 2 in which most of the trailing edge of the mainsail is occupied by the rearwardly directed jet nozzle.

4. A sailing rig according to claim 3 having end plates flaring out horizontally forward to overlap the sector through which the jib pivots.

5. A sailing rig according to claim 4 in which said end plates flare out in the general shape of the letter "Y".

6. A sailing rig comprising:

a rigid mainsail;

a jib at the leading surface of the mainsail pivotally mounted thereat and forming an effective air seal between the windward and leeward sides of an airfoil assembly which the mainsail and jib together comprise;

intake means, visible from the front of the airfoil assembly, which, when the jib is pivoted to windward, are open on the leeward side and obstructed on the windward side;

a rearwardly directed jet nozzle occupying the trailing edge of the mainsail, its jet being pivotable to align with the lee surface of the mainsail;

the open intake inlet area of said intake means being at least 20% greater than the exhaust area of the jet nozzle;

an airfoil assembly interior divided into a front and rear compartment, the intake means feeding the front compartment and the exhaust jet nozzle exiting the rear compartment; and fan means pressurizing the rear compartment with air drawn from the front compartment;

the entire assembly being rotatable in relation to a vessel upon which it is mounted.

7. A sailing rig according to claim 6 having end plates flaring out horizontally forward to overlap the sector through which the jib pivots.

8. A sailing rig according to claim 7 in which said end plates flare out in the general shape of the letter "Y".

9. A sailing rig according to claim 7 in which the intake means are mounted near the front of the airfoil assembly and take air into said front compartment from where it is drawn by fan means into said pressurized rear compartment, from where the air exits via the jet nozzle.

10. A sailing rig comprising:

airfoil means including:

a mainsail having a front, a jib at the front of the mainsail, and means for pivoting the jib at the front of the mainsail with the jib's trailing edge fitting so closely to the mainsail as to provide an effective airseal between mainsail and jib;

intake means for drawing air into the foil from a leeward side of the airfoil means; and nozzle means for extending a jet of air from most of a trailing edge of the airfoil means, said jet being comprised substantially of air taken into the airfoil means from the leeward side.

11. A sailing rig according to claim 10 in which the air intake means are on the leading surface of the mainsail, said rig further including valve means formed at least in part by the jib, which when pivoted to windward, closes windward intake means and opens leeward intake means.

12. A sailing rig comprising:

rigid airfoil means for changing a direction, energy, and momentum of a mass of air moving relative to said airfoil means, the airfoil means including:

a mainsail, a jib at the front of the mainsail, and means for pivoting the jib at the front of the mainsail with the jib's, trailing edge fitting so closely to the mainsail as to provide an effective airseal between mainsail and jib;

intake means for drawing air from only a leeward side of the airfoil means which intake means are valved by valve means for closing windward intake means and opening leeward intake means; and jet nozzle means for increasing an effective sail area of the rig by extending a jet of air from most of a trailing edge of the airfoil means, to which jet the moving air mass remains attached for some distance past the trailing edge.

13. A sailing rig according to claim 12 in which the jib serves as the valve means for closing the windward intake means and opening the leeward intake means.

14. A sailing rig comprising:

rigid airfoil means for altering the flow of a mass of air;

intake means for drawing air substantially from only a leeward side of the airfoil means;

nozzle means for extending a jet of air from most of a trailing edge of the airfoil means;

said airfoil means comprising:

mainsail means; and jib means at the front of the mainsail means;

means for pivoting the jib means from the front of the mainsail means.

* * * * *

UNITED STATES PATENT AND TRADEMARK OFFICE

CERTIFICATE OF CORRECTION

PATENT NO. : 4,669,409

DATED : June 2, 1987

INVENTOR(S) : Gunnar C.F. Asker

It is certified that error appears in the above-identified patent and that said Letters Patent is hereby corrected as shown below:

Col. 9, line 18: Change "sealing" to --sailing--.

Signed and Sealed this

Thirteenth Day of October, 1987

*Attest:*

DONALD J. QUIGG

*Attesting Officer*

*Commissioner of Patents and Trademarks*